US006010033A

United States Patent [19]

Dean

[11] Patent Number: 6,010,033

[45] Date of Patent: Jan. 4, 2000

[54] REFRIGERATED BEVERAGE DISPENSER

[76] Inventor: Roger J. Dean, 3 Waterbury La., Danbury, Conn. 06811

[21] Appl. No.: 09/098,404

[22] Filed: Jun. 16, 1998

[51] Int. Cl.[7] ..... B67D 5/62

[52] U.S. Cl. ..... 222/113; 222/146.6; 222/192; 222/131; 222/183; 222/185.1

[58] Field of Search ..... 222/146.1, 146.6, 222/113, 192, 131, 183, 185.1, 160; 141/370

[56] References Cited

U.S. PATENT DOCUMENTS

| | | | |
|---|---|---|---|
| 1,910,262 | 5/1933 | Schoenfeld | 222/113 |
| 2,151,115 | 3/1939 | Johnson | 222/113 |
| 2,433,977 | 7/1948 | Bently | 222/146.6 |
| 3,152,728 | 10/1964 | McCarter | 222/146.6 |
| 4,722,300 | 2/1988 | Walker et al. | 222/650 |
| 4,913,713 | 4/1990 | Bender et al. | 222/146.6 |

*Primary Examiner*—Kevin P. Shaver
*Assistant Examiner*—Eric Keasel

[57] ABSTRACT

A new refrigerated beverage dispenser for dispensing a cool beverage. The inventive device includes an insulated housing having a generally rectangular configuration. The housing has a top wall, a bottom wall, a front wall, a back wall, and opposed side walls. The front wall has an upper opening therein. The front wall has a lower opening therein. The lower opening is in communication with the upper opening. The lower opening is dimensioned for receiving a drinking glass therein. A refrigeration unit is disposed within the insulated housing. A reservoir is slidably received within the upper opening of the housing. The reservoir has an open upper end and a closed lower end. The closed lower end has a spout extending downwardly therefrom for positioning within the lower opening of the housing.

8 Claims, 2 Drawing Sheets

30
24
32
26
16

38
12:31
36
42
12
40
34
20
28

24
26
36
18
12

REFRIGERATED BEVERAGE DISPENSER

BACKGROUND OF THE INVENTION

1. Field of the Invention

The present invention relates to water dispensing systems and more particularly pertains to a new refrigerated beverage dispenser for dispensing a cool beverage.

2. Description of the Prior Art

The use of water dispensing systems is known in the prior art. More specifically, water dispensing systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art water dispensing systems include U.S. Pat. No. 5,421,159 to Stokes; U.S. Pat. No. 4,350,267 to Nelson et al.; U.S. Pat. No. Des. 309,462 to Russell; U.S. Pat. No. 4,456,149 to Sciortino; U.S. Pat. No. 5,290,442 to Clack; and U.S. Pat. No. 4,440,318 to Berger.

While these devices fulfill their respective, particular objectives and requirements, the aforementioned patents do not disclose a new refrigerated beverage dispenser. The inventive device includes an insulated housing having a generally rectangular configuration. The housing has a top wall, a bottom wall, a front wall, a back wall, and opposed side walls. The front wall has an upper opening therein. The front wall has a lower opening therein. The lower opening is in communication with the upper opening. The lower opening is dimensioned for receiving a drinking glass therein. A refrigeration unit is disposed within the insulated housing. A reservoir is slidably received within the upper opening of the housing. The reservoir has an open upper end and a closed lower end. The closed lower end has a spout extending downwardly therefrom for positioning within the lower opening of the housing.

In these respects, the refrigerated beverage dispenser according to the present invention substantially departs from the conventional concepts and designs of the prior art, and in so doing provides an apparatus primarily developed for the purpose of dispensing a cool beverage.

SUMMARY OF THE INVENTION

In view of the foregoing disadvantages inherent in the known types of water dispensing systems now present in the prior art, the present invention provides a new refrigerated beverage dispenser construction wherein the same can be utilized for dispensing a cool beverage.

The general purpose of the present invention, which will be described subsequently in greater detail, is to provide a new refrigerated beverage dispenser apparatus and method which has many of the advantages of the water dispensing systems mentioned heretofore and many novel features that result in a new refrigerated beverage dispenser which is not anticipated, rendered obvious, suggested, or even implied by any of the prior art water dispensing systems, either alone or in any combination thereof.

To attain this, the present invention generally comprises an insulated housing having a generally rectangular configuration. The housing has a top wall, a bottom wall, a front wall, a back wall, and opposed side walls. The front wall has an upper opening therein. The upper opening has a pair of slots on opposed sides thereof. The upper opening has a door hingedly coupled thereto. The front wall has a lower opening therein. The lower opening is in communication with the upper opening. The lower opening is dimensioned for receiving a drinking glass therein. The top wall has an opening therein in communication with the upper opening. The opening in the top wall has a lid hingedly coupled thereto. A refrigeration unit is disposed within the insulated housing. A reservoir is slidably received within the upper opening of the housing. The reservoir has an open upper end and a closed lower end. The open upper end has a peripheral flange extending therearound. The peripheral flange slides within the slots of the upper opening to facilitate coupling of the reservoir to the upper opening. The closed lower end has a spout extending downwardly therefrom for positioning within the lower opening of the housing. A clock is disposed within the front wall of the housing. The clock has settings buttons disposed within the front wall of the housing. A light source is disposed within the front wall of the housing. The light source has a power switch in communication therewith.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new refrigerated beverage dispenser apparatus and method which has many of the advantages of the water dispensing systems mentioned heretofore and many novel features that result in a new refrigerated beverage dispenser which is not anticipated, rendered obvious, suggested, or even implied by any of the prior art water dispensing systems, either alone or in any combination thereof.

It is another object of the present invention to provide a new refrigerated beverage dispenser which may be easily and efficiently manufactured and marketed.

It is a further object of the present invention to provide a new refrigerated beverage dispenser which is of a durable and reliable construction.

An even further object of the present invention is to provide a new refrigerated beverage dispenser which is susceptible of a low cost of manufacture with regard to both materials and labor, and which accordingly is then susceptible of low prices of sale to the consuming public, thereby making such refrigerated beverage dispenser economically available to the buying public.

Still yet another object of the present invention is to provide a new refrigerated beverage dispenser which provides in the apparatuses and methods of the prior art some of the advantages thereof, while simultaneously overcoming some of the disadvantages normally associated therewith.

Still another object of the present invention is to provide a new refrigerated beverage dispenser for dispensing a cool beverage.

Yet another object of the present invention is to provide a new refrigerated beverage dispenser which includes an insulated housing having a generally rectangular configuration. The housing has a top wall, a bottom wall, a front wall, a back wall, and opposed side walls. The front wall has an upper opening therein. The front wall has a lower opening therein. The lower opening is in communication with the upper opening. The lower opening is dimensioned for receiving a drinking glass therein. A refrigeration unit is disposed within the insulated housing. A reservoir is slidably received within the upper opening of the housing. The reservoir has an open upper end and a closed lower end. The closed lower end has a spout extending downwardly therefrom for positioning within the lower opening of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
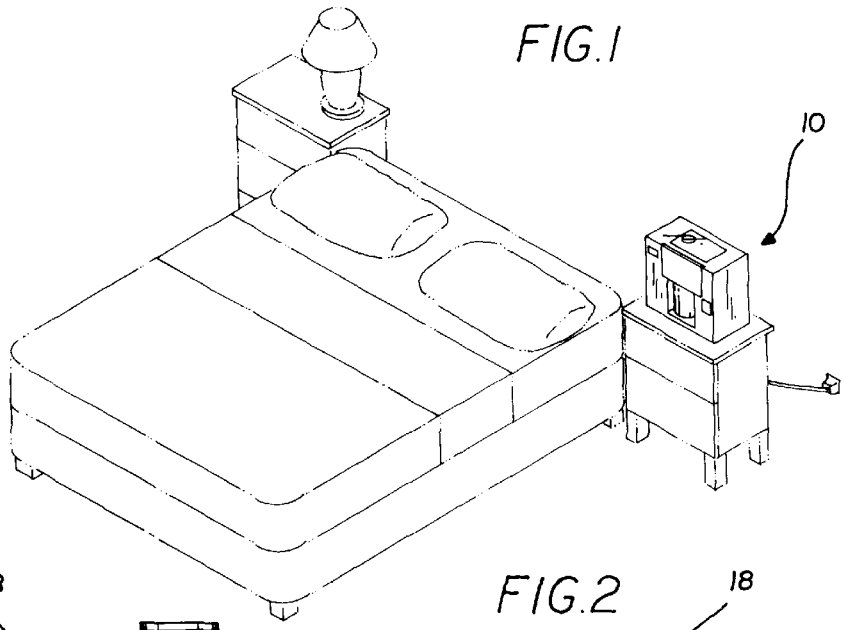
FIG. 1 is a perspective view of a new refrigerated beverage dispenser according to the present invention illustrated within a bedroom.
Figure 2:
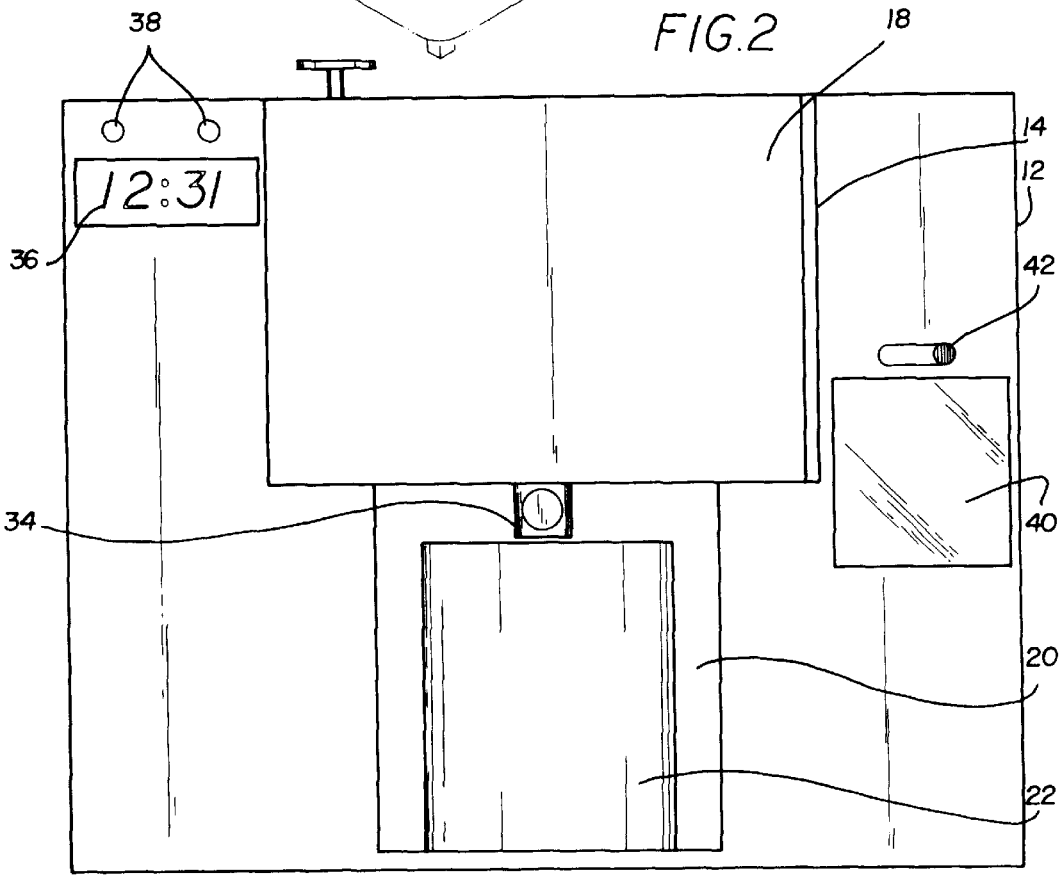
FIG. 2 is a front elevation view of the present invention.
Figure 3:
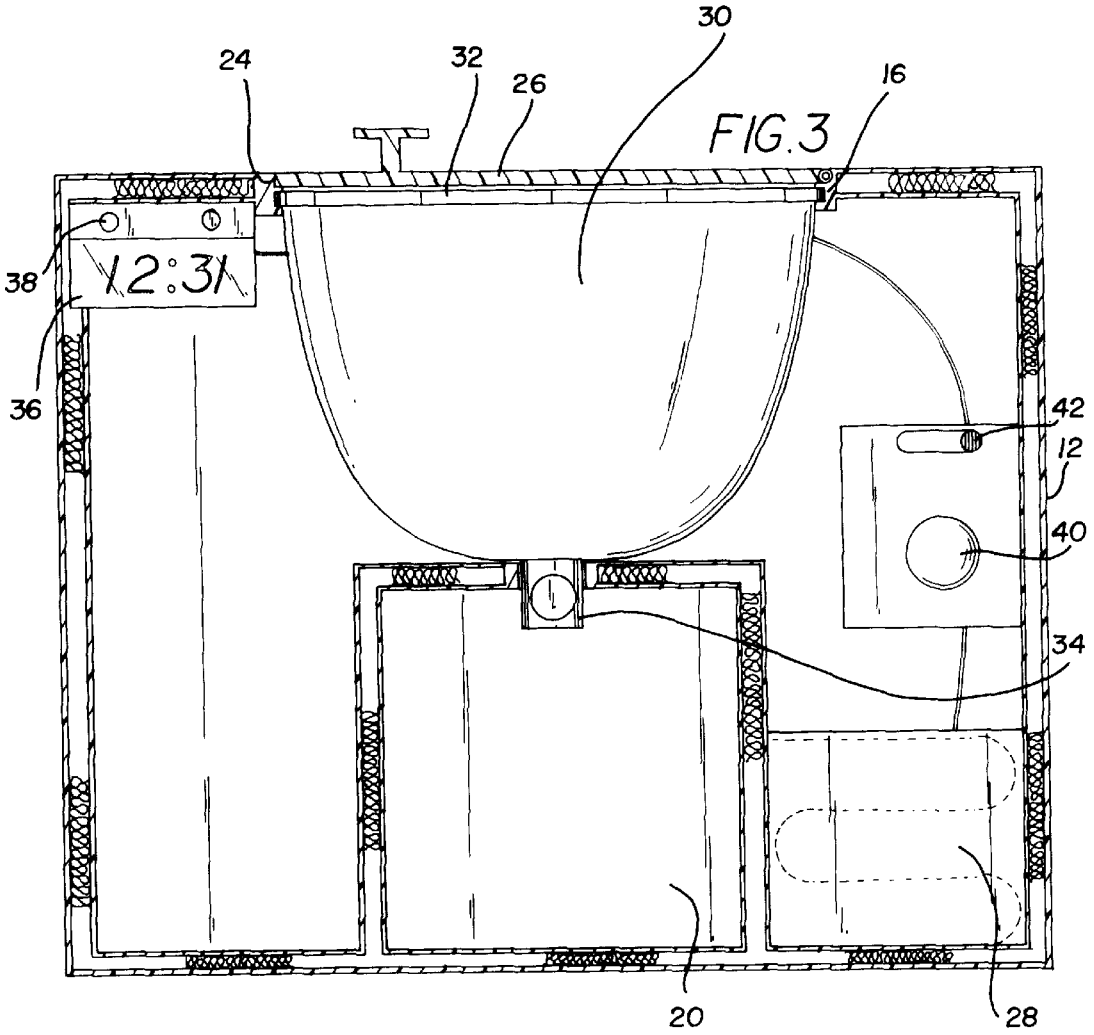
FIG. 3 is a cross-sectional front view of the present invention.
Figure 4:
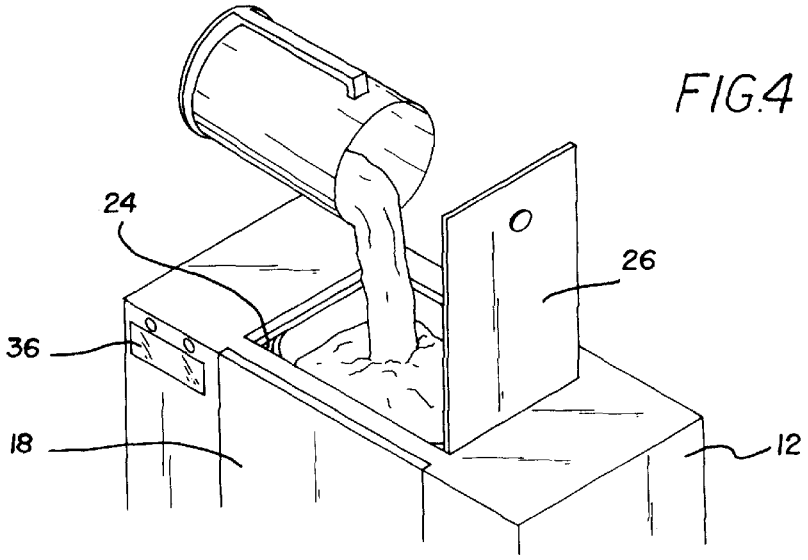
FIG. 4 is a partial perspective view of the present invention illustrating the filling of the reservoir thereof.

With reference now to the drawings, and in particular to FIGS. 1 through 4 thereof, a new refrigerated beverage dispenser embodying the principles and concepts of the present invention and generally designated by the reference numeral 10 will be described.

As best illustrated in FIGS. 1 through 4, the refrigerated beverage dispenser 10 comprises an insulated housing 12 having a generally rectangular configuration. The housing 12 has a top wall, a bottom wall, a front wall, a back wall, and opposed side walls. The front wall has an upper opening 14 therein. The upper opening 14 has a pair of slots 16 on opposed sides thereof. The upper opening 14 has a door 18 hingedly coupled thereto. The front wall has a lower opening 20 therein. The lower opening 20 is in communication with the upper opening 14. The lower opening 20 is dimensioned for receiving a drinking glass 22 therein. The top wall has an opening 24 therein in communication with the upper opening 14. The opening 24 in the top wall has a lid 26 hingedly coupled thereto.

A refrigeration unit 28 is disposed within the insulated housing 12.

A reservoir 30 is slidably received within the upper opening 14 of the housing 12. The reservoir 30 has an open upper end and a closed lower end. The open upper end has a peripheral flange 32 extending therearound. The peripheral flange 32 slides within the slots 16 of the upper opening 14 to facilitate coupling of the reservoir 30 to the upper opening 14. The closed lower end has a spout 34 extending downwardly therefrom for positioning within the lower opening 20 of the housing 12.

A clock 36 is disposed within the front wall of the housing 12. The clock 36 has settings buttons 38 disposed within the front wall of the housing. The clock 36 enables removal of an existing alarm clock from a user's night stand to eliminate clutter.

A light source 40 is disposed within the front wall of the housing 12. The light source 40 has a power switch 42 in communication therewith. The light source 40 can be activated at night time to illuminate the device 10 for easy viewing in the dark.

In use, the present invention will preferably be positioned on a user's bedside table to enable the user to have a cold drink of water or other beverage while in bed. The user simply fills the reservoir 30 with water or other liquid and places it within the upper opening 14. The refrigeration unit 28 will chill the water or liquid. Additional water could be added to the reservoir 30 without its removal by lifting the lid 26 to expose the opening 24 in the top wall of the housing 12 whereby the user can pour water directly into the reservoir 30. The user then places a glass or cup 22 within the lower opening 20 and presses a release button on the spout 34 to release the water from the reservoir 30 into the glass or cup 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new refrigerated beverage dispenser for dispensing a cool beverage comprising, in combination:

an insulated housing having a generally rectangular configuration, the housing having a top wall, a bottom wall, a front wall, a back wall, and opposed side walls, the front wall having an upper opening therein, the upper opening having a pair of slots on opposed sides thereof, the upper opening having a door hingedly coupled thereto, the front wall having a lower opening therein, the lower opening being in communication with the upper opening, the lower opening being dimensioned for receiving a drinking glass therein, the top wall having an opening therein in communication with the upper opening, the opening in the top wall having a lid hingedly coupled thereto;

a refrigeration unit disposed within the insulated housing;

a reservoir slidably received within the upper opening of the housing, the reservoir having an open upper end and a closed lower end, the open upper end having a peripheral flange extending therearound, the peripheral flange sliding within the slots of the upper opening to facilitate coupling of the reservoir to the upper opening, the closed lower end having a spout extending downwardly therefrom for positioning within the lower opening of the housing;

a clock disposed within the front wall of the housing, the clock having settings buttons disposed within the front wall of the housing;

a light source disposed within the front wall of the housing, the light source having a power switch in communication therewith.

2. A new refrigerated beverage dispenser for dispensing a cool beverage comprising, in combination:

an insulated housing having a generally rectangular configuration, the housing having a top wall, a bottom wall, a front wall, a back wall, and opposed side walls, the front wall having an upper opening therein, the front wall having a lower opening therein, the lower opening being in communication with the upper opening, the lower opening being dimensioned for receiving a drinking glass therein;

a refrigeration unit disposed within the insulated housing;

a reservoir slidably received within the upper opening of the housing, the reservoir having an open upper end and a closed lower end, the closed lower end having a spout extending downwardly therefrom for positioning within the lower opening of the housing.

3. The refrigerated beverage dispenser as set forth in claim 2 wherein the upper opening has a door hingedly coupled thereto.

4. The refrigerated beverage dispenser as set forth in claim 2 wherein the top wall of the housing has an opening therein in communication with the upper opening.

5. The refrigerated beverage dispenser as set forth in claim 4 wherein the opening in the top wall of the housing has a lid hingedly coupled thereto.

6. The refrigerated beverage dispenser as set forth in claim 2 wherein the open upper end of the reservoir has a peripheral flange extending therearound, the peripheral flange sliding within slots within opposed side of the upper opening to facilitate coupling of the reservoir to the upper opening.

7. The refrigerated beverage dispenser as set forth in claim 2 and further including a clock disposed within the front wall of the housing, the clock having settings buttons disposed within the front wall of the housing.

8. The refrigerated beverage dispenser as set forth in claim 2 and further including a light source disposed within the front wall of the housing, the light source having a power switch in communication therewith.

* * * * *